US005495937A

United States Patent [19]

Fraser

[11] Patent Number: 5,495,937

[45] **Date of Patent: * Mar. 5, 1996**

[54] SHIPPING AND DISPLAY CONTAINER FOR MOTORIZED IMPLEMENT

[75] Inventor: Ronald A. Fraser, Chandler, Ariz.

[73] Assignee: Ryobi North America, Inc., Easley, S.C.

[ * ] Notice: The portion of the term of this patent subsequent to Jul. 26, 2011, has been disclaimed.

[21] Appl. No.: 279,657

[22] Filed: Jul. 25, 1994

Related U.S. Application Data

[63] Continuation-in-part of Ser. No. 6,375, Jan. 19, 1993, Pat. No. 5,332,085.

[51] Int. Cl.[6] ..... B65D 5/50; B65D 71/08

[52] U.S. Cl. ..... 206/45.14; 206/320; 206/349; 206/386; 206/485; 206/497; 206/526; 206/597

[58] Field of Search ..... 206/45.14, 45.19, 206/349, 386, 370, 526, 597, 600, 386, 320, 485; 211/70.6

[56] References Cited

U.S. PATENT DOCUMENTS

| | | |
|---|---|---|
| 2,291,645 | 8/1942 | Nordquist . |
| 2,727,620 | 12/1955 | Buttery . |
| 2,752,035 | 6/1956 | Shinoda . |
| 3,481,453 | 12/1969 | Shreve, III et al. . |
| 3,570,658 | 3/1971 | Swanberg . |
| 3,669,253 | 6/1972 | Hanko . |
| 3,741,380 | 6/1973 | Carney . |
| 3,747,831 | 7/1973 | Hanson . |
| 3,747,835 | 7/1973 | Graser . |
| 3,825,113 | 7/1974 | Kramer et al. . |
| 3,874,500 | 4/1975 | Nicholl . |
| 4,171,050 | 10/1979 | Murray et al. . |
| 4,247,003 | 1/1981 | Jones . |
| 4,287,991 | 9/1981 | Donnelly . |
| 4,354,598 | 10/1982 | Schillinger . |
| 4,549,654 | 10/1985 | Tiesman . |
| 4,848,563 | 7/1989 | Robbins . |
| 4,915,224 | 4/1990 | Wulf et al. . |
| 5,048,677 | 9/1991 | Pedracine . |
| 5,114,002 | 5/1992 | Warner . |

*Primary Examiner*—Bryon P. Gehman
*Attorney, Agent, or Firm*—Brooks & Kushman

[57] ABSTRACT

A shipping and display container, a generally C-shaped or L-shaped configuration enabling vertical orientation of an elongated motor driven tool is disclosed. The container allows access to the tool without destruction or manipulation of the shipping and display container. In addition, the tool may be utilized as a handle for carrying both the tool and container. The container has display surfaces adapted to receive point of sale display graphics while greatly increasing the viewing angle of consumers approaching the container.

25 Claims, 6 Drawing Sheets

SHIPPING AND DISPLAY CONTAINER FOR MOTORIZED IMPLEMENT

CROSS REFERENCE TO RELATED APPLICATION

This is a continuation-in-part of U.S. Ser. No. 08/006,375, filed Jan. 19, 1993, entitled "Shipping and Display Container For Lawn Implement", now issued U.S. Pat. No. 5,332,085.

TECHNICAL FIELD

The present invention relates to shipping and display cartons and more particularly to shipping and display containers for motor driven tools.

BACKGROUND OF THE INVENTION

Motor driven tools such as lawn implements and vacuum cleaners are designed to withstand abuse and to feel comfortable in the hands of an operator. This durability and comfort is often the key factor in determining whether or not to purchase the product. Therefore, it is important for consumers to be able to touch and grip the product at the point of sale prior to making the purchase decision.

Traditionally, packages for such products were enclosed in corrugated containers with the consumer having to rely on a picture or description on the outer carton. Consumers interested in obtaining access to the product were forced to open the packaging to test for durability and feel of the product. Such activity by the consumer resulted in a number of opened and/or damaged packages which made subsequent sale difficult. In an attempt to minimize damaged containers, many retailers now take several units completely out of the enclosed cartons to use for display purposes. These display units have frequently sustained damage and theft of the most removable components resulting in a "return to vendor" situation.

In addition to the inability to touch the product without opening conventional packaging, such conventional packaging made carrying the product from the display to the cash register and subsequently to the consumer's destination difficult due to the cumbersome size of the product and its packaging. In addition, traditional packages for lawn implements or the like have been displayed either in a horizontal fashion or in a inverted fashion such that the motor end of the implement is located at the lower end of the package. This horizontal or inverted display of the product does not provide the consumer with the opportunity to view the product in its in-use orientation.

The present invention is directed to improving known shipping and display containers for motor driven tools such as lawn implements, vacuum cleaners, or the like.

SUMMARY OF THE INVENTION

The present invention provides a container for shipping and displaying a motor driven tool. The container has a body portion defining an open central region for receiving the tool in an upright orientation. The body portion also has a rear panel and a plurality of side panels, each of the plurality of side panels having a first side section and a second side section. The first side section is oriented generally perpendicular to the rear panel and the second side section is integrally connected to the first side section and folded back toward the rear panel. Preferably, the second side sections engage with one anther or else the rear panels. A top portion and a bottom portion are contiguous with the first side panels of the body portion and extend outwardly from the rear panel beyond the first side sections. The bottom is located opposite the top portion for supporting the container in a generally vertical orientation when placed upon a flat horizontal surface. An upper retainer may be provided which cooperates with the top portion for removably retaining the upper end of the tool. A lower retainer may cooperate with the bottom portion for removably retaining the implement end of the lawn implement. The upper and lower retainers may also cooperate with the open central region to enable the tool to be used as a handle for carrying the container.

Another object of the present invention is to provide a system for shipping a plurality of elongated implements. A plurality of shipping containers are provided each having a body portion having a rear panel and a pair of side panels which cooperate with the rear panel to form two triangular tubes when seen in cross section. A top portion and a bottom portion are provided which are contiguous with the side panels in opposed relation such that the top and bottom portions project from the rear panel beyond the side panels. A base is provided which is sized to receive a plurality of shipping containers in a generally vertical orientation such that at least two of the shipping containers are oriented face-to-face such that their respective rear panels are exposed. A lid is provided which is sized to substantially surround the top portions of the same number of shipping containers as received by the base. A wrap is provided which substantially surrounds the lid, the base and the plurality of shipping containers to form an immobile unit.

An object of the present invention is to provide a shipping and display container capable of being displayed in a vertical, in-use orientation.

Another object of the present invention is to provide a shipping and display carton providing the consumer access to the product and to use the tool to carry the container from the on-sale display area to.

A further object of the present invention is to provide a shipping and display container capable of being shipped in combination with a plurality of other shipping and display containers to provide a sturdy and secure shipping unit which protects the product against damage while easily being unpacked and separated from the other shipping and display containers for point of sale display.

Still another object of the present invention is to provide a plurality of billboard panels on the shipping and display container to provide for large angled advertising space easily viewed by consumers as they approach the on-sale display from different angles.

A feature of the present invention is that the container may enable the motor end of the lawn implement to be displayed distal from the floor in a vertical orientation.

Another feature of the present invention is the angled billboard surfaces surrounding the tool which are used to attract attention to the product by consumers approaching at different angles.

An advantage of the present invention is allowing consumers access to the product at point of sale display without requiring tampering of the shipping and display container.

A further advantage of the present invention is enabling the handle area of-the tool to be utilized in carrying the product thereby avoiding conventional cumbersome movement of such products.

The above objects, features and advantages of the present invention are readily apparent from the following detailed description of the invention when taken in connection with the accompanying drawings.

DETAILED DESCRIPTION OF THE INVENTION

Figure 1:
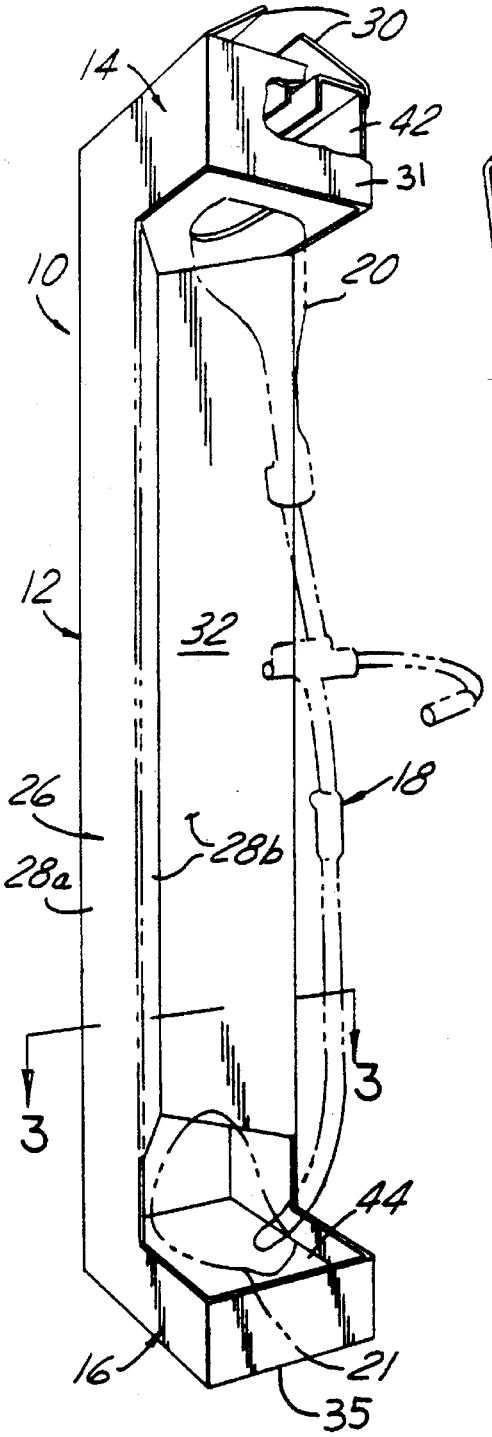
FIG. 1 is a perspective view of a first embodiment of a shipping and display container, partially cutaway, showing a top retainer and showing a lawn implement contained within the shipping and display container in phantom, made in accordance with the present invention.

The first embodiment illustrated in FIGS. 1 through 7 depicts a shipping and display container 10. The container is formed from a body portion 12, a top portion 14 and a bottom portion 16.

As shown in FIG. 1, the container 10 is intended to be utilized to display an elongated lawn implement, generally indicated at 18, in a generally vertical orientation. In this orientation, an upper end 20 of the lawn implement 18 is located above an implement end 21 of the lawn implement 18. The upper end 20 of the lawn implement 18 in this embodiment contains the motor (whether electric or gasoline) which is considerably heavier than the implement end 21. In order to display the lawn implement 18 in such a manner it is essential that the container 10 be sturdy.

Figure 4:
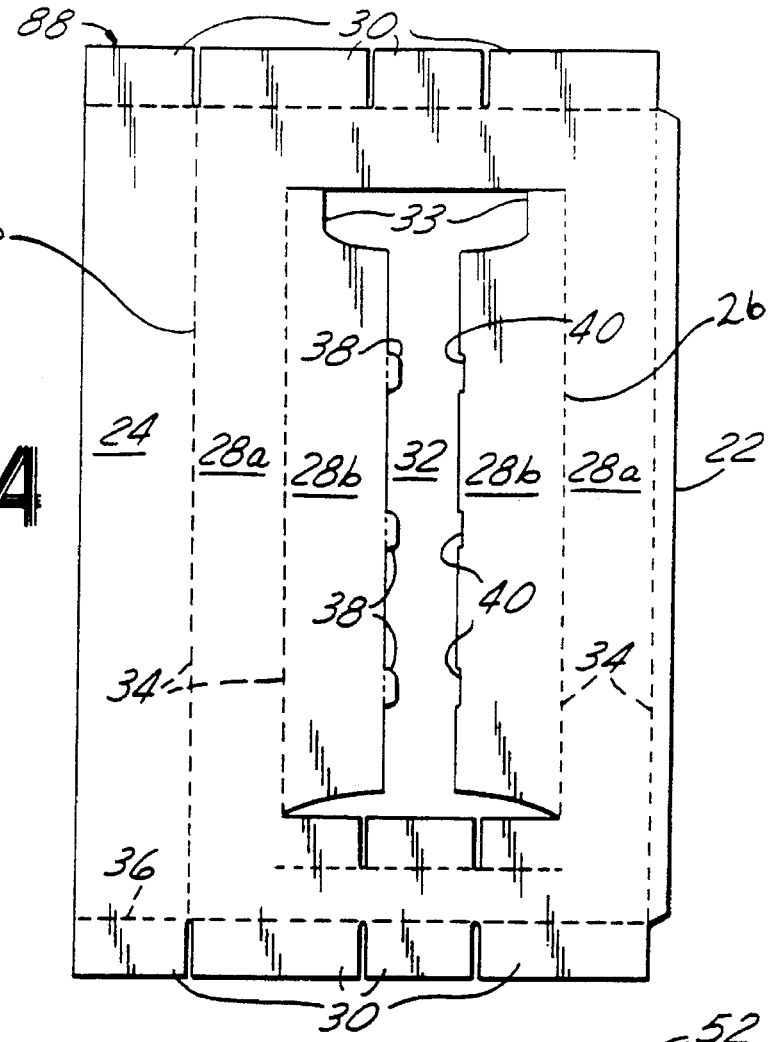
FIG. 4 is a plan view of the blank utilized to form the shipping and display container shown in FIG. 1.

A blank 88 depicted in FIG. 4 and the assembled product shown in FIG. 1 best illustrate the relationship of the elements forming the container 10. The container 10 has a connecting panel 22 which cooperates with a rear panel 24 to form the container 10. Adjacent the rear panel 24 and generally perpendicular thereto are a pair of side panels 26. The side panels 26 each have a first side section 28*a* and a second side section 28*b*.

The first side sections 28*a*, in conjunction with segments of top and bottom portions 14 and 16 form, a generally C-shaped configuration as best seen in FIG. 1. The top portion 14 and the bottom portion 16 are each contiguous with the side panels 26.

As shown in FIGS. 1 and 4, each of the top and bottom portions, 14 and 16, has flaps 30. The top and bottom portions are formed adjacent the side panels 26 extending beyond the first side sections 28*a* such that a face section 31 extends between the side panels 26 generally perpendicular thereto and distal from the rear panel 24. The bottom portion provides a generally flat surface area or base 35 which is adapted for supporting the container 10 in a generally vertical orientation when the container 10 is placed on a flat horizontal surface. An open central region 32 is defined as the area between the rear panel 24, the top and bottom portions 14 and 16, and the second side sections 28*b*. The open central region 32 is generally elongated and enables consumers to have access to the lawn implement 18 without manipulating the container 10. The open central region 32, defined by rear panel 24, top and bottom portions 14 and 16, and second side sections 28*b*, provide large angled advertising spaces or billboard panels which are easily viewed by consumers as they approach the container 10.

The container 10 is formed from folding the blank 88 along a plurality of longitudinal fold or score lines 34 and a pair of transverse fold lines 36. Fastening cement or a similar adhesive compound is applied to the juncture between the rear panel 24 and the connecting panel 22. The second side sections 28*b* are then folded back toward the rear panel 24 into interlocking engagement to form an angle therebetween lying within a range of 60°–120°. The second side sections 28*b* interlock with one another. One of the second side sections 28*b* has tabs 38 and the other second side section 28*b* has corresponding cutout 40 adapted to receive the tab 38. In this embodiment, there are three tabs 38 which are seated within three cutouts 40. Prior to closing the flaps 30, an upper retainer 42 (shown in FIGS. 1 and 2) is inserted into the top portion 14. A lower retainer 44 is inserted into the bottom portion 16.

Figure 2:
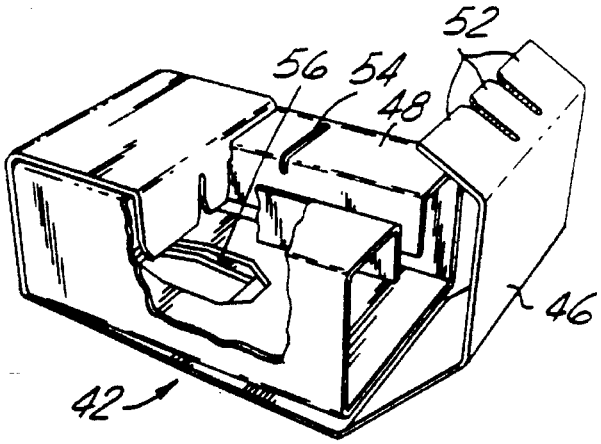
FIG. 2 is a perspective view, partially broken away, of the top having one tab disengaged.
Figure 5:
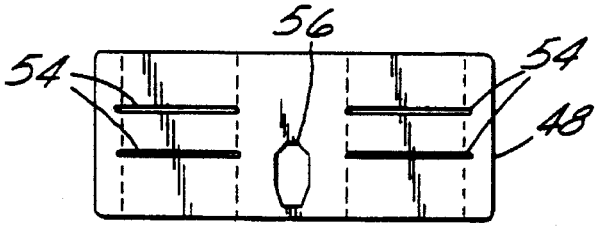
FIG. 5 is a plan view, similar to that shown in FIG. 4, of a second blank utilized to form the top retainer.
Figure 6:
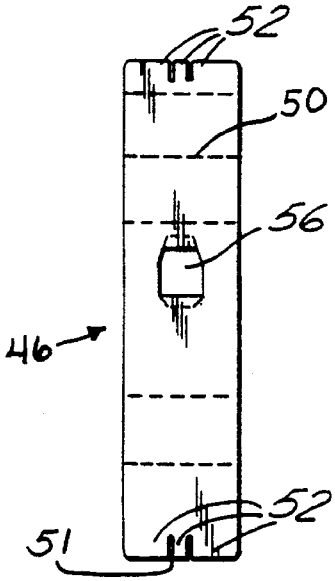
FIG. 6 is a plan view of a third blank which cooperates with the blank shown in FIG. 5 to form the top retainer shown in FIG. 2.

As best shown in FIGS. 2, 5 and 6, the upper retainer 42 is formed from a first member 46 and a second member 48. The first member 46 is a generally rectangular piece of cardboard or the like having a plurality of transverse fold lines 50 and a pair of longitudinal cuts 51 to form tabs 52 at each end of the first member 46. The second member 48, shown in FIG. 5 is also rectangular in shape and has a plurality of transverse fold lines bisected by a pair of longitudinal slots 54 adapted to receive the tabs 52. The first member 46 and second member 48 are each folded along their respective fold lines such that the first member 46 is folded around the second member 48 and tabs 52 are inserted into slots 54 to form a complete unit. A cutout 56 is centrally located within each of the first and second members 46 and 48 when combined to form the upper retainer 42, the cutouts 56 adapt to removably receive and retain the upper end 20 of the lawn implement 18. The upper retainer 42 is placed within the top portion 14 such that the cutout 56 is facing the open central region 32 of the container 10. The upper retainer 42 is prevented from falling into the open central region 32 by upper ends of the second side sections 28*b* which are in interlocking relation.

Figure 3:
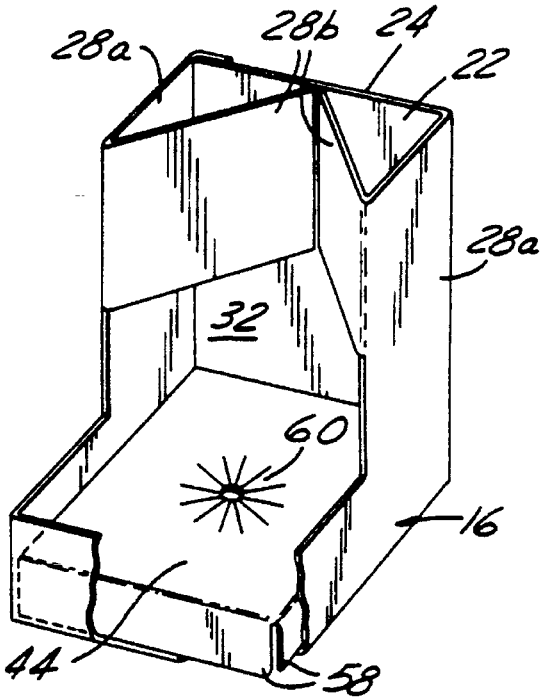
FIG. 3 is a perspective view taken along line 3—3 of FIG. 2, showing a second retainer.
Figure 7:
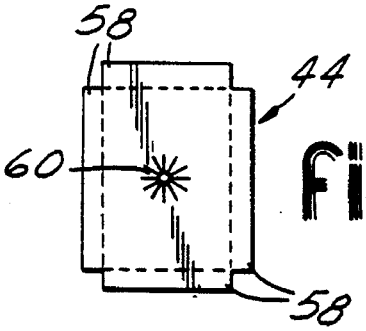
FIG. 7 is a plan view of a blank utilized in retaining the implement portion of the lawn implement.
Figure 8:
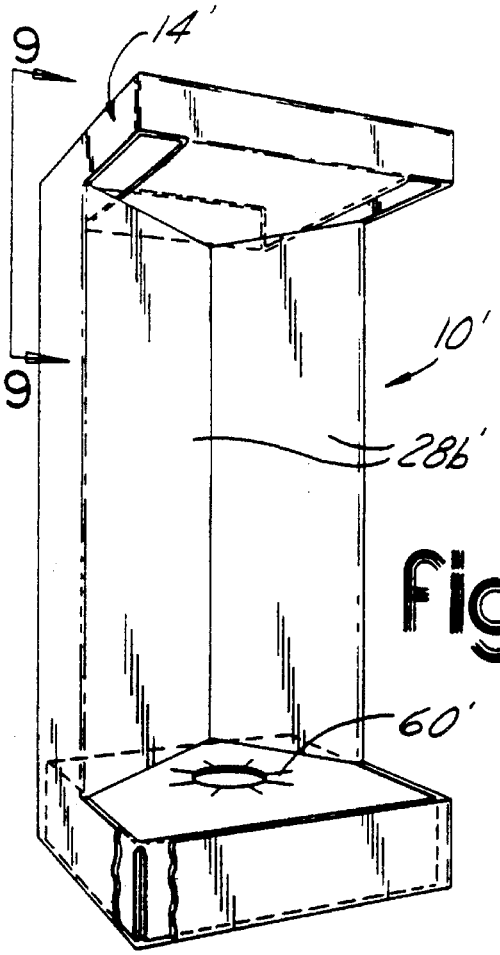
FIG. 8 is a perspective view, partially cutaway, showing a shipping and display container for an accessory to the lawn implement shown in FIG. 1.
Figure 9:
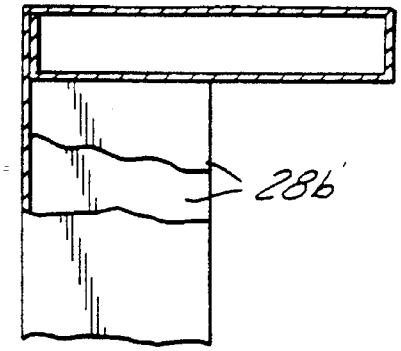
FIG. 9 is a side view, partially cutaway, taken along line 9—9 of FIG. 8.
Figure 11:
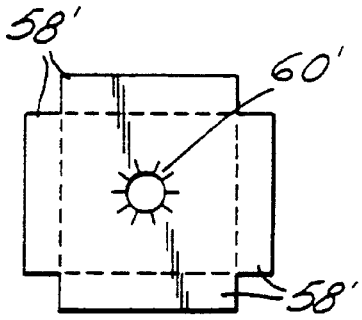
FIG. 11 is a plan view of the blank utilized to form the bottom retainer shown in FIG. 8.

The lower retainer 44, best shown in FIGS. 3 and 7, is a generally square shaped piece of cardboard or the like. A pair of transverse fold lines and a pair of longitudinal fold lines are located so as to provide flanges 58 which surround the lower retainer and provide a base upon which the lower retainer 44 rests in the bottom portion 16 (shown in FIG. 3). A plurality of radial slots defining a series of cantilevered retainers 60 are centrally located within the lower retainer 44 for removably receiving and retaining the implement end 21 of the lawn implement 10.

Figure 12:
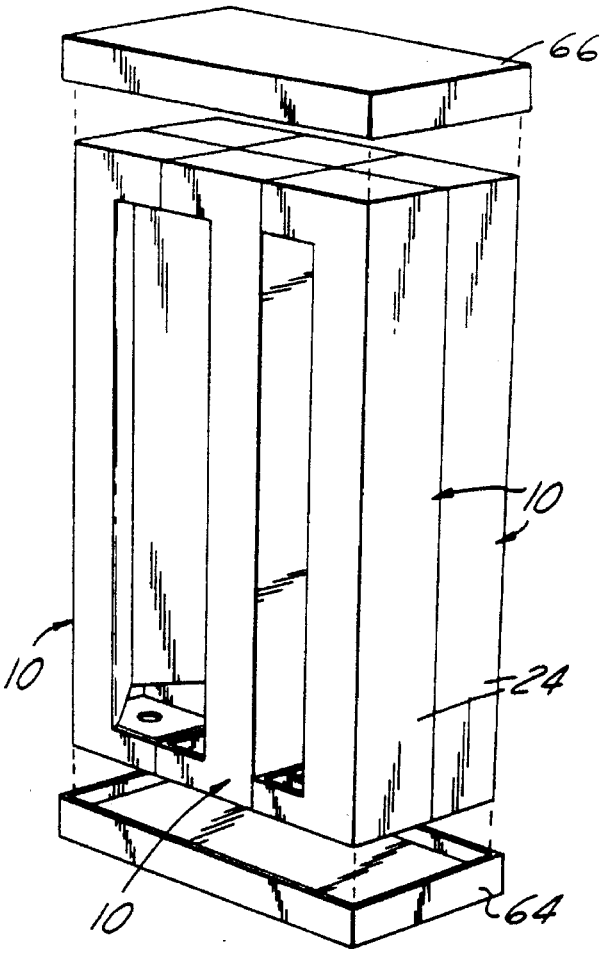
FIG. 12 is a perspective view, partially exploded, showing the formation of a shipping unit in accordance with the present invention.
Figure 13:
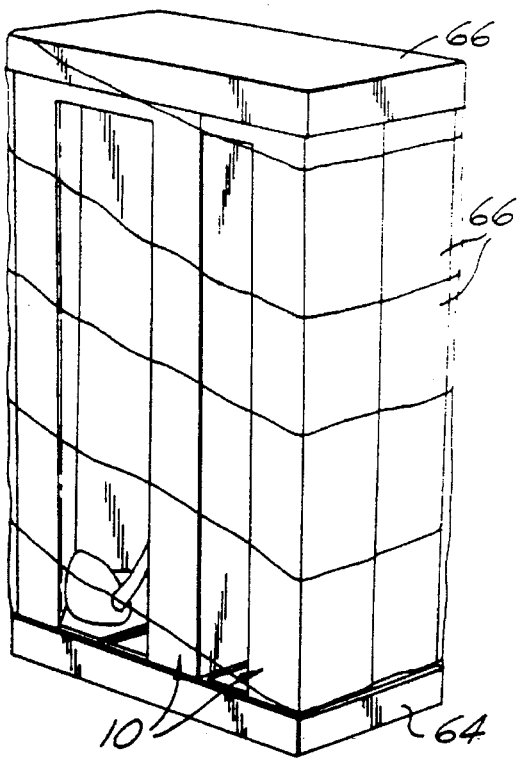
FIG. 13 is a perspective view, similar to that shown in FIG. 12, illustrating a completed shipping unit wrapped in plastic.
Figure 14:
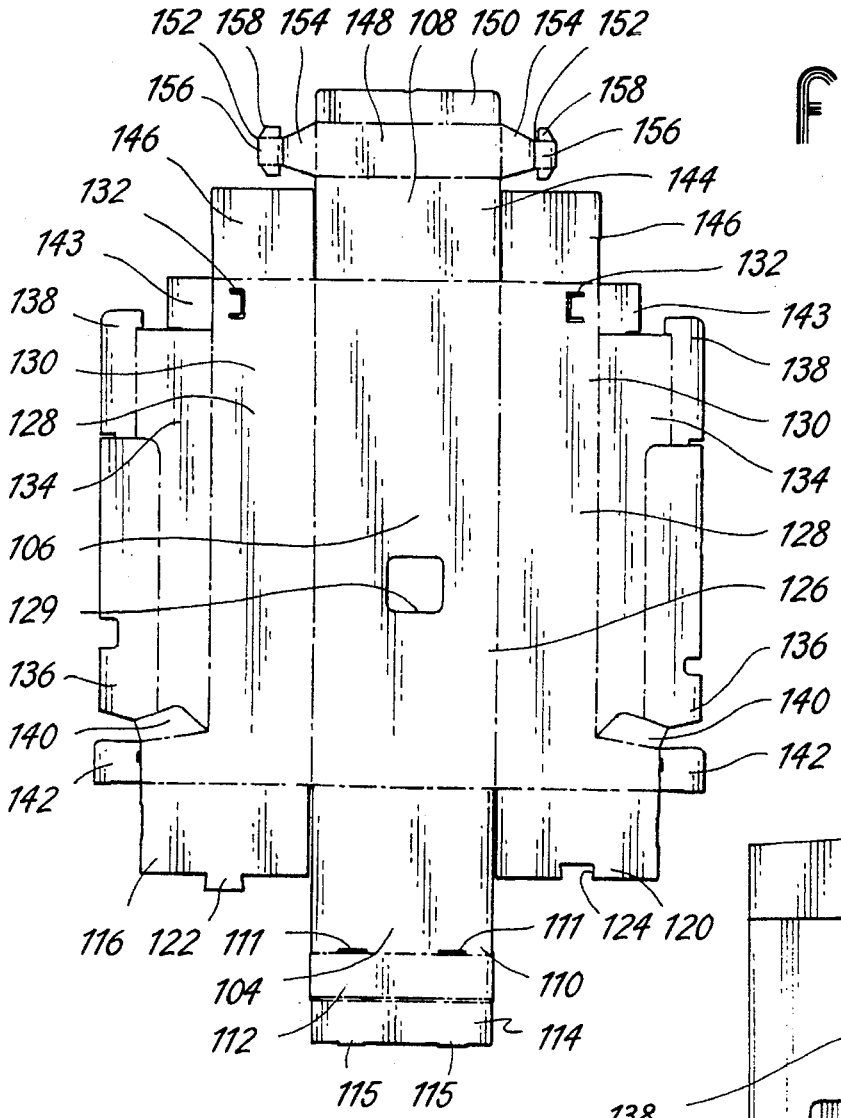
FIG. 14 is a second embodiment of the invention showing a blank used to form a point of sales display carton for a vacuum cleaner.

FIGS. 12 and 13 illustrate a system for shipping a plurality of the elongated lawn implements 18 within the shipping and display containers 10. A base 64 is generally rectangular in shape and is adapted to receive a plurality of containers 10 in a generally vertical orientation. The containers 10 are placed within the base 64 such that at least two of the plurality of containers 10 are oriented face to face thereby exposing two rear panels 24. In this embodiment, six containers 10 are placed within the base 64 such that at each corner of the base 64 rear panels 24 are exposed. The cross sectional shape of the container 10 (as shown in FIG. 3) illustrates two closed triangular tubes, which in conjunction with the lawn implement 18, provide the container 10 with a rigid structure. The rear panels 24 of the containers 10 are exposed at the corners of the base 64 to take advantage of this rigid construction.

A lid 66 is shaped similar to that of the base and sized to receive the same number of containers 10 as the base 64. The lid 66 is placed over the top portions 14 of the containers 10. Then a wrap 68, in this configuration a translucent wrap, is shrink fitted around the base 64, the lid 66, and the containers 10 to form a secure integral unit for shipping.

Figure 10:
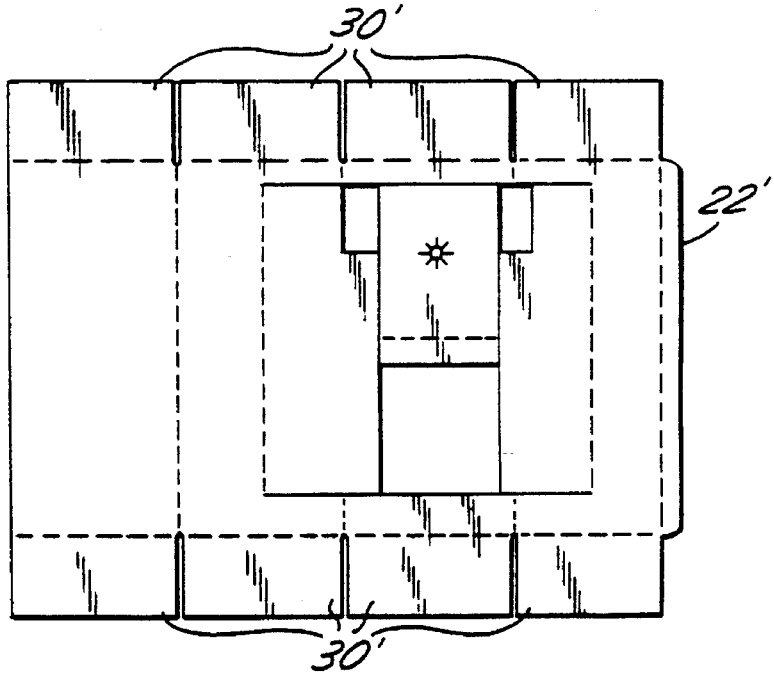
FIG. 10 is a plan view of the blank utilized to form the shipping and display container illustrated in FIG. 8.

The embodiment shown in FIGS. 8–11 illustrates a shipping and display container 10' for shipping elongated attachments 70 for the lawn implement 18. An elongated attachment 70 or working end is shown already attached within lawn implement 18 in FIG. 1. The general configuration, construction and function of this embodiment is similar to that shown in FIGS. 1–7. The numbers identified in FIGS. 8–11 have the same number corresponding to the embodiment shown in FIGS. 1–7 with the addition of a prime number to designate the alternative embodiment. One exception to the general construction is that the upper retainer 42' is integrally formed within the body portion 12' as shown in FIG. 10.

A second embodiment of a shipping and display container 100 is shown in FIGS. 14–17. Stamped blank 102 in FIG. 14 can be folded to form the display container 100 depicted in FIG. 15. Display container 100 includes a base portion 104, a main body 106 and a top portion 108. The dash lines indicate scored fold lines and the solid lines indicate cuts or separations between flaps or panels.

Base portion 104 includes a base panel 110, a first flap 112 and a second flap 114 and a pair of laterally spaced side flaps 116 and 120. Formed in base panel 110 are pair of slots 111 which are sized to receive a corresponding pair of tabs 115 on second flap 114. Side flap 116 has a tab 122. Side flap 120 has a recess 124 sized to retain tab 122. Side flaps 116 and 120 are separated from base flap 110.

Main body 106 includes a rear panel 126 and a pair of laterally disposed side panels 128. Rear panel 126 has an access opening 129. Each side panel 128 includes a first side section 130, second side section 134, lower and upper end flaps 136 and 138, fold down panels 140 and tabs 142 and 143. First side sections 130 are L-shaped and have C-shaped cuts 132 formed nea their top ends. Fold-down panels 140 are separated from intermediate second side section 134 and lower end flap 136 and are adjoined to first side sections 130. Tabs 142 extend laterally outward from the lower end of first side sections 130.

Top portion 108 includes top panel 144, side panels 146, first and second flaps 148 and 150, and tab assemblies 152. Each tab assembly 152 includes a trapezoidal panel 154 connected to a rectangular flap 156 and a pair of vertically spaced end tabs 158. Side panels 146 are cut from top panel 144.

Figure 15:
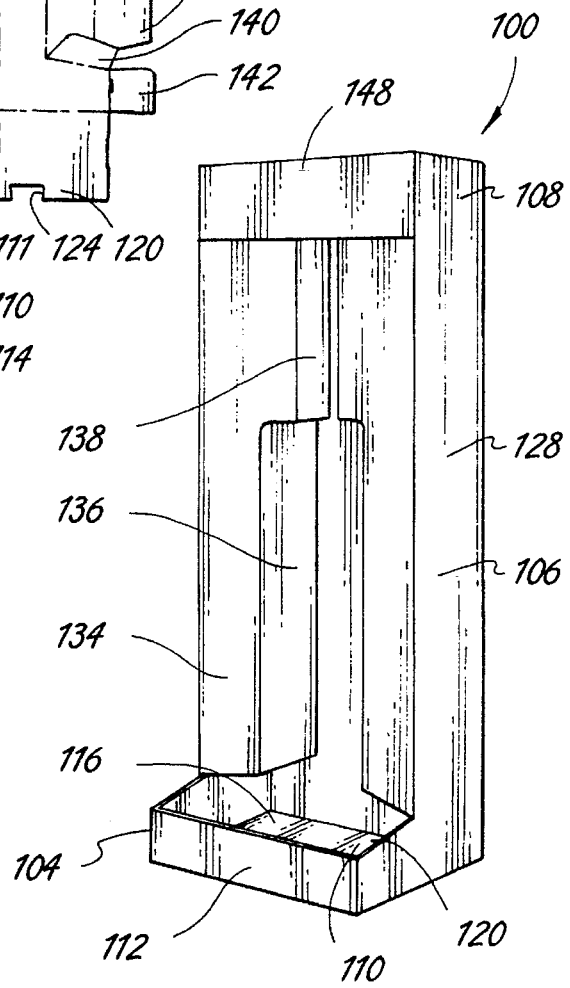
FIG. 15 is a perspective view of the display carton constructed from the blank of FIG. 14.
Figure 16:
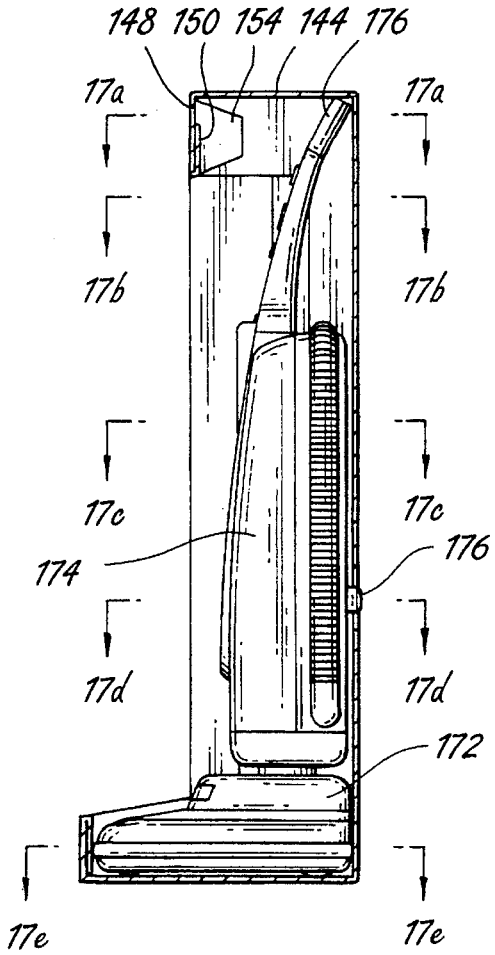
FIG. 16 is a side sectional view of the display carton with a vacuum cleaner held therewithin.

Folded-up display container 100 is illustrated in FIG. 15. Sectional views are shown in FIGS. 16 and 17*a–e*. The following steps are taken in folding up container 100. First, each of side panel 128 is folded perpendicular and forward with respect to rear panel 126. Side flaps 116 and 120 are then folded horizontally and perpendicularly to respective first side sections 130. Base flap 110 is folded perpendicular to rear panel 126 and flat against side flaps 116 and 120 to form a floor to container 100.

Second flap 114 is folded over first flap 112 with tabs 115 fitting into slots 111. Tabs 142 are inserted between the respective slots formed between first and second flaps 112 and 114 thus forming base portion 104 to container 100.

Top portion 108 is next folded together. Side panels 146 are bent normal to respective side panels 128 to lie horizontally. Top panel 144 then folds perpendicular to rear panel 126 overlying side panels 146 and forming a roof-like top to container 100. First flap 148 folds downward from top panel 144 to form the top front. Second flap 150 then folds upwardly. Tabs 143 fold perpendicular to first side sections 130 or rearwardly into the slot formed between first and second flaps 146 and 148. Finally, tab assembly 152 are folded backwards on the lateral outsides of first side sections 130. Rectangular flap 156 and end tabs 158 are received into C-shaped cuts 132 to complete the formation of top portion 108.

Figure 17A:
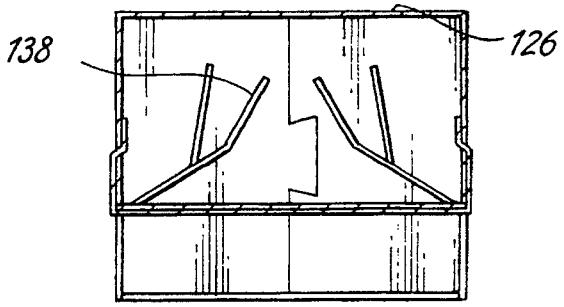
FIGS. 17*a*–17*e* are sectional views taken along corresponding sections from FIG. 16.
Figure 17B:
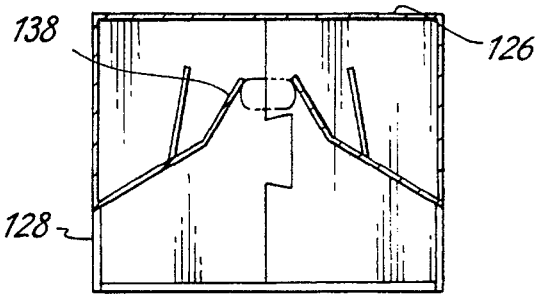
Figure 17C:
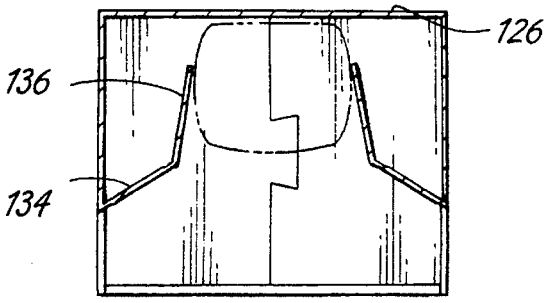
Figure 17E:
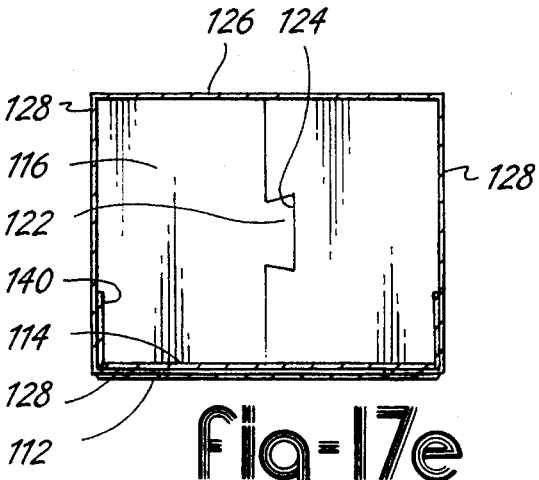
Figure 17D:
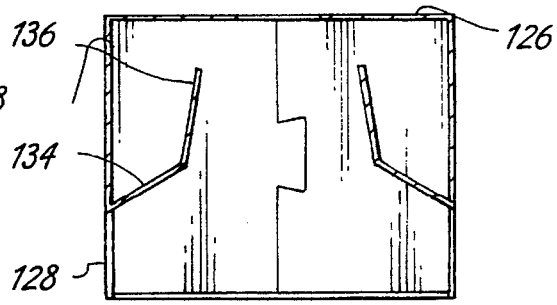

Finally, main body 106 is created. Second side section 134 is bent back at an acute angle with respect to first side section 130 as illustrated in FIG. 17*a–d*. Second side section 134 is folded back towards rear panel 126. Upper end flaps 138 are also folded with respect to second side section 134 as shown in FIGS. 17*a* and *b*. The angles of folding of these members is controlled to conform with a vacuum cleaner 170 to be stored therein.

Vacuum cleaner 170 is a conventional upright vacuum cleaner. Components of interest include a base 172, a main hard body 174 having an elongate rear carrying bracket 176 therein, and a curved handle 178. Hard body 174 is generally oval in cross-section and is pivotally connected to base 172 and also may selectively lock into a vertical orientation with respect to base 172. Bracket 176 is accessible through access opening 129 in rear panel 126. A consumer can readily grab this carrying bracket 176 by one hand and carry, in a balanced manner, the combination of vacuum cleaner 170 and container 100 to a check-out point.

Upper and lower foam inserts 180 and 182 fit within top portion 108 and base portion 104 about respective handle 178 and base 172. Foam insert 180 has slots therein for receiving and holding in place upper end flap 138.

Second side sections 134, lower end flaps 136 and upper end flaps 138 again serve as angled display surfaces for advertisements.

While the best modes for carrying out the invention has been described in detail, those familiar with the art to which this invention relates will recognize various alternative designs and embodiments for practicing the invention as defined by the following claims.

What is claimed is:

1. A point-of-sale display and access arrangement comprising:

a substantially fully assembled motorized implement having a housing with a motor therein, an elongate member extending from the housing and a handle attached to one of the housing and the elongate member; and a folded-up cardboard display carton having a first portion, a second portion, a body portion connecting the first and second portions and an insert, at least one of the first and second portions having the insert disposed therein with the insert providing structural support to the first and second portion and the insert retaining a portion of the motorized implement;

the body portion having a rear panel and a pair of side panels which at least partially define an open channel, each side panel including a first side section and a second side section, the first side sections extending generally perpendicularly from the rear panel and the second side sections extending from the first side sections back toward the rear panel with the second side sections engaging the insert;

the first portion is contiguous with the side panels of the body portion and has a pair of side sections extending outwardly from the rear panel and a face section extending between the side sections of the first portion and spaced from the rear panel;

the second portion is contiguous with the side panels of the body portion and has a pair of side sections extending outwardly from the rear panel beyond the first side sections and a face section extending between and perpendicular to the side sections of the second portion and spaced from the rear panel, the second portion adapted for supporting the motorized implement in a generally vertical orientation when the second portion is placed upon a flat horizontal surface;

wherein the arrangement may be oriented in an upright position with the second portion resting upon a horizontal surface and the first portion being maintained vertically thereabove so that the motorized implement may be displayed; and wherein the elongate member lies adjacent the open channel between the first and second portions so that the elongate member is displayed and the motorized implement is tactilely accessible at the point of sale and the arrangement of the carton and motorized implement can be carried in a generally horizontal fashion by using the motorized implement as a handle to carry the arrangement to a cash register and ultimately to a consumer's final destination.

2. The arrangement of claim 1 wherein:

the second side sections are arranged at an acute angle relative to the first side sections.

3. The arrangement of claim 1 wherein:

the second side sections are at least partially spaced from the motorized implement so that the second side sections are visible from the front of the arrangement.

4. The arrangement of claim 3 wherein:

the second side sections have graphics printed thereon.

5. The arrangement of claim 1 wherein:

the carton is C-shaped with the first and second portions extending forwardly from the body portion.

6. The arrangement of claim 1 wherein:

each of the first and second portions have inserts therein which retain the motorized implement.

7. The arrangement of claim 1 wherein:

the second side sections cooperate with the rear panel to enhance the structural rigidity of the arrangement.

8. The arrangement of claim 1 wherein:

the arrangement can be horizontally carried and balanced by grasping the motorized implement with a single hand with the elongate member being in a horizontal orientation.

9. The arrangement of claim 1 wherein:

the first and second sections are part of a closed section.

10. The arrangement of claim 9 wherein:

the closed sections are triangular in cross-section.

11. The arrangement of claim 9 wherein:

the first and second sections cooperate with the rear panel in forming the closed sections.

12. The arrangement of claim 1 wherein:

the second sections engage one another.

13. A point-of-sale display and access arrangement comprising:

a motorized implement having a motor within a housing, a handle, and an elongate member extending from the housing; and a folded-up cardboard .display carton having a first portion and a second portion and a body portion connecting the first and second portions, the first and second portions extending forwardly from the body portion;

the body portion having a rear panel and a pair of side panels which define an open channel, each side panel including a first side section and a second side section, the first side sections extending generally perpendicularly from the rear panel and the second side sections extending from the first side sections back toward and engaging the rear panel to structurally enhance the rigidity of the carton;

wherein the arrangement may be oriented in an upright position with the second portion resting upon a horizontal surface and the first portion being maintained vertically thereabove so that the elongate member extends vertically when the second portion is resting on-the horizontal surface; and wherein the elongate member lies adjacent the open channel between the first and second portions so that at least a portion of the housing and the elongate member are displayed and are tactilely accessible at the point of sale and the arrangement of the carton and implement can be carried using the motorized implement as a handle.

14. The arrangement of claim 13 wherein:

at least one of the first and second portions has an insert therein for supporting one of the housing and the elongate member.

15. The arrangement of claim 14 wherein:

each of the first and second portions has an insert therein, the inserts respectively supporting the housing and elongate member.

16. The arrangement of claim 14 wherein:

the second side sections are at least partially spaced from the motorized implement so that the second side sections are visible from the front of the arrangement.

17. The arrangement of claim 13 wherein:

the first portion is contiguous with the side panels of the body portion, the first portion having a pair of side sections extending outwardly from the rear panel beyond the first side sections and a face section extending between and perpendicular to the side sections of the first portion and spaced from the rear panel; and the second portion is contiguous with the side panels of the body portion and opposite the first portion., the second portion adapted for supporting the implement in a generally vertical orientation when placed upon a flat horizontal surface.

18. The arrangement of claim 13 wherein:

the second side sections are arranged at an acute angle relative to the first side sections.

19. The arrangement of claim 13 wherein:

the first and second sections are part of a closed section.

20. A point-of-sale display and access arrangement comprising:

a fully assembled motorized implement having a housing with a motor therein, an elongate member extending from the housing and a handle attached to the housing; and a C-shaped folded-up cardboard display carton having a first portion, a second portion, a body portion connecting the first and second portions, and first and second inserts;

the first and second portions extending forwardly from the body portion having the respective first and second inserts disposed therein with the inserts providing structural support to the respective first and second portions and the first and second inserts retaining portions of the motorized implement;

the body portion having a rear panel and a pair of side panels which define an open channel, each side panel including a first side section and a second side section, the first side sections extending generally perpendicularly from the rear panel and the second side sections extending from and being inclined to the first side sections back toward the rear panel with the second side sections engaging the rear panel and one another to form a pair of closed triangular sections, the second side sections are at least partially spaced from the motorized implement so as to be visible from the front of the arrangement and the second side sections have graphics printed thereon;

the first portion is contiguous with the side panels of the body portion and has a pair of side sections extending outwardly from the rear panel and a face section extending between and perpendicular to the side sections of the first portion and spaced from the rear panel;

the second portion is contiguous with the side panels of the body portion and has a pair of side sections extending outwardly from the rear panel and a face section extending between and perpendicular to the side sections of the second portion and spaced from the rear panel, the second portion adapted for supporting the motorized implement in a generally vertical orientation when the second portion is placed upon a flat horizontal surface;

wherein the arrangement may be oriented in an upright position with the second portion resting upon a horizontal surface and the first portion being maintained vertically thereabove so that the motorized implement may be displayed; and wherein the elongate member lies adjacent the open channel between the first and second portions so that the elongate member is displayed and the motorized implement is tactilely accessible at the point of sale and the arrangement of the carton and motorized implement can be carried by a single hand with the elongate member being in a generally horizontal orientation by using the handle of the motorized implement to transport the arrangement to a cash register and ultimately to a consumer's final destination.

21. A point-of-sale display and access arrangement comprising:

a substantially fully assembled motorized implement having a housing with a motor therein and an elongate member extending from the housing; and a folded-up cardboard display carton having a first portion, a second portion, and a body portion connecting the first and second portions and an insert, at least one of the first and second portions having the insert disposed therein with the insert providing structural support to the at least one of the first and second portions and the insert retaining a portion of the motorized implement, the body portion having a rear panel and a pair of first outboard side panels, the first outboard side panels attaching to the rear panel to at least partially define an open channel, the body portion further including a pair of second inboard side panels cooperatively engaging the respective first side panels and extending rearwardly therefrom at an inclined angle toward and engaging the rear panel, the pair of second inboard side panels being supported by the first outboard side panels and the rear panel to form an angled display surface for point-of-sale graphics;

the first portion is contiguous with the outboard side panels of the body portion and has a pair of side sections extending outwardly from the rear panel and a face section extending between the side sections of the first portion and spaced from the rear panel;

the second portion is contiguous with the outboard side panels of the body portion and has a pair of side sections extending outwardly from the rear panel and a face section extending between the side sections of the second portion and spaced from the rear panel;

wherein the arrangement may be oriented in an upright position with the second portion resting upon a horizontal surface and the first portion being maintained vertically thereabove so that the motorized implement is displayed in a vertical manner; and wherein the elongate member lies adjacent the open channel between the inboard side panels so that the elongate member is displayed and the motorized implement is tactilely accessible at the point-of-sale.

22. The arrangement of claim 21 wherein:

the carton is generally C-shaped with the first and second portions protruding forwardly of the first outboard panels.

23. The arrangement of claim 21 wherein:

the carton is generally L-shaped with the second portion protruding forwardly of the first outboard panels.

24. The arrangement of claim 21 wherein:

at least a portion of the elongate member is tactilely accessible.

25. The arrangement of claim 21 wherein:

the carton is provided with a pair of inserts respectively located in the first and second portion of the carton for retaining opposed ends of the motorized implement.

* * * * *